US010167105B2

(12) United States Patent
Armello et al.

(10) Patent No.: US 10,167,105 B2
(45) Date of Patent: Jan. 1, 2019

(54) APPARATUS FOR MANUFACTURE OF PACKAGING CONTAINER WITH RECLOSABLE CONNECTION AND METHOD OF MANUFACTURE

(71) Applicant: Disc Graphics Inc., Hauppauge, NY (US)

(72) Inventors: Diamond J. Armello, Smithtown, NY (US); Mitch Serraino, Kings Park, NY (US)

(73) Assignee: DISC GRAPHICS INC., Hauppauge, NY (US)

( * ) Notice: Subject to any disclaimer, the term of this patent is extended or adjusted under 35 U.S.C. 154(b) by 541 days.

(21) Appl. No.: 14/022,885

(22) Filed: Sep. 10, 2013

(65) Prior Publication Data

US 2014/0008363 A1 Jan. 9, 2014

Related U.S. Application Data

(62) Division of application No. 12/959,702, filed on Dec. 3, 2010, now Pat. No. 8,529,422.

(51) Int. Cl.
*B65D 5/20* (2006.01)
*B31B 50/00* (2017.01)
(Continued)

(52) U.S. Cl.
CPC ..... *B65D 5/20* (2013.01); *B31B 50/00* (2017.08); *B31B 50/814* (2017.08);
(Continued)

(58) Field of Classification Search
CPC ..... B65D 5/20; B65D 2313/04; B31B 2203/082; B31B 1/00; B31B 2201/9061; B31B 3/26; B31B 1/90
(Continued)

(56) References Cited

U.S. PATENT DOCUMENTS 2,784,757 A 3/1957 Bosca et al.
3,326,399 A 6/1967 Ausnit
(Continued)

FOREIGN PATENT DOCUMENTS

FR 1191546 A 10/1959
GB 382471 A 10/1932
(Continued)

OTHER PUBLICATIONS

"A handbook for designers, converters and buyers of paperboard packaging", Paperboard Packaging Council; Alexandria, Va; 2nd Edition (2004).

(Continued)

*Primary Examiner* — Thanh Truong
*Assistant Examiner* — Xavier A Madison
(74) *Attorney, Agent, or Firm* — Carter, DeLuca, Farrell & Schmidt, LLP

(57) ABSTRACT

An apparatus for manufacturing and converting a container includes a platform for slidably accommodating a sheet of packaging material, an actuation mechanism for feeding the sheet through the platform, and a gluing device for applying glue to a portion of the sheet. The apparatus further includes a magnet applicator assembly housing a plurality of magnets, a slug applicator assembly housing a plurality of slugs and a folding mechanism to align the sheet in a final glued form. The magnet applicator assembly applies magnets to the sheet at a pre-determined time, and the slug applicator assembly applies slugs to the sheet at a pre-determined time. The magnet and the slug are attached to the sheet by the glue applied by the gluing device. The magnet aligns with the slug forming a reclosable connection.

15 Claims, 18 Drawing Sheets

(51) Int. Cl.
*B31B 50/81* (2017.01)
*B31B 100/00* (2017.01)

(52) U.S. Cl.
CPC .. *B31B 2100/0022* (2017.08); *B65D 2313/04* (2013.01); *Y10T 156/1036* (2015.01)

(58) Field of Classification Search
USPC ..... 229/122.24; 220/230; 493/156, 114, 493/128, 130, 131, 117; 53/491, 411
See application file for complete search history.

(56) References Cited

U.S. PATENT DOCUMENTS

| | | | | |
|---|---|---|---|---|
| 3,749,301 | A * | 7/1973 | Peckar | B65D 5/6673 220/315 |
| 4,738,390 | A | 4/1988 | Brennan | |
| 5,505,305 | A | 4/1996 | Scholz et al. | |
| 5,687,848 | A | 11/1997 | Scholz et al. | |
| 5,704,480 | A | 1/1998 | Scholz et al. | |
| 5,758,936 | A | 6/1998 | Baughan | |
| 6,297,719 | B1 | 10/2001 | Miller | |
| 6,626,291 | B2 | 9/2003 | Pozzoli | |
| 6,749,551 | B2 | 6/2004 | Metzler et al. | |
| 6,981,590 | B1 | 1/2006 | Ubel et al. | |
| 7,028,834 | B2 | 4/2006 | Karpel | |
| 7,089,627 | B2 | 8/2006 | Seidler | |
| 7,240,876 | B2 | 7/2007 | Doubleday et al. | |
| 7,303,074 | B2 | 12/2007 | Dombrowski et al. | |
| 7,451,879 | B2 | 11/2008 | Ford et al. | |
| 7,641,051 | B2 | 1/2010 | Ford et al. | |
| 2002/0070135 | A1 | 6/2002 | Sanders | |
| 2003/0067156 | A1* | 4/2003 | Sebastian | B42F 13/0006 281/21.1 |
| 2003/0121807 | A1 | 7/2003 | Oguchi | |
| 2004/0206638 | A1* | 10/2004 | Metzler | B65D 5/721 206/1.5 |
| 2005/0230465 | A1 | 10/2005 | Metzler et al. | |
| 2005/0237202 | A1 | 10/2005 | Nichols | |
| 2007/0231058 | A1 | 10/2007 | Vincent et al. | |
| 2008/0014258 | A1 | 1/2008 | Boehm et al. | |
| 2008/0173702 | A1 | 7/2008 | Meister | |
| 2008/0185010 | A1 | 8/2008 | Kesselman et al. | |
| 2008/0237077 | A1* | 10/2008 | Sage | B42F 7/08 206/425 |
| 2010/0190627 | A1* | 7/2010 | Ishizuka | B31B 1/04 493/128 |
| 2010/0206757 | A1 | 8/2010 | Kesselman | |
| 2012/0035038 | A1 | 2/2012 | Lembach et al. | |
| 2012/0261304 | A1 | 10/2012 | Busri | |
| 2013/0020383 | A1 | 1/2013 | Tautz et al. | |

FOREIGN PATENT DOCUMENTS

| | | | |
|---|---|---|---|
| GB | 2427590 | A | 1/2007 |
| JP | 2002-059987 | A | 2/2002 |
| WO | 03/058626 | A2 | 7/2003 |
| WO | 2006/106093 | A1 | 10/2006 |
| WO | 2008/152344 | A1 | 12/2008 |

OTHER PUBLICATIONS

Supplementary European Search Report issued in corresponding Application No. EP14783145 dated Feb. 10, 2017, 10 pages.

* cited by examiner

APPARATUS FOR MANUFACTURE OF PACKAGING CONTAINER WITH RECLOSABLE CONNECTION AND METHOD OF MANUFACTURE

CROSS-REFERENCE TO RELATED APPLICATION

This application is a divisional application of U.S. patent application Ser. No. 12/959,702 filed Dec. 3, 2010, now U.S. Pat. No. 8,529,422 the entirely of which is incorporated herein by reference.

BACKGROUND

Technical Field

The present disclosure relates to an apparatus for manufacture and conversion of a packaging container, more particularly, to an apparatus for manufacture and conversion of a packaging container with reclosable connection and a method of manufacture and conversion of the packaging container.

Background of Related Art

A folder-gluer machine is commonly used in the packaging industry for paperboard converting process, which entails conversion of flat paperboard sheets into die-cut segments which are folded and glued to form a carton or package. Such machine includes a plurality of processing modules or stations disposed along the feed direction of the sheet. The number of processing modules depends on the complexity of the manufacturing operations required by the type of box chosen. The sheet is conveyed from station to station by, for example, belt conveyors, which frictionally seize the sheet either between lower and upper belts or between lower belts and upper support and/or rollers. Conveyor system typically includes three or more longitudinal members each supporting a continuous conveyor belt supported by pulleys and rollers.

Typically, the folder-gluer machine includes at least a feeder that feeds the box production line sheets, a gluing device that coats glue onto the glue tab of the sheet, a folding device that folds the sheet and a sensor that detects the passing of the front edge of the cardboard sheet in order to carry out, for example, folding after the elapse of a pre-set time following detection of the front edge.

In one known example, a folder-gluer machine can include an untimed straight line gluer making all folds by a series of fixed plows and gluing is accomplished by either a continuous wheel application of adhesive or a simple timed application of hot melt. In contrast, a folder-gluer machine with a timed straight line gluer includes means for creating leading and trailing panel folds, as well as the conventional machine direction folds, such that complex internal flap or tab folds, as well as intricate glue patterns may be achieved with the timed straight line gluer.

In addition, the folder-gluer machine may further include a crease device forming pre-folded creases on the sheet, a pressing device that applies pressure to the sheet and a delivery module that receives the boxes while keeping them pressed to allow the glue to dry.

SUMMARY

In accordance with the present disclosure, one aspect of the present invention is an apparatus for manufacturing or converting a container from flat stock. The apparatus includes a platform for slidably accommodating a sheet of packaging material, an actuation mechanism for feeding the sheet through the platform, and a gluing device for applying glue to a portion of the sheet. The apparatus further includes a magnet applicator assembly housing a plurality of magnets therein, a slug applicator assembly housing a plurality of slugs therein, and a folder aligning the sheet in a final glued form. The magnet applicator assembly applies at least one magnet to the sheet at a pre-determined time. The slug applicator assembly applies a slug to the sheet at a pre-determined time. The magnet and the slug are attached to the sheet by the glue applied by the gluing device. The magnet is aligned with the slug forming a reclosable connection.

In one embodiment, the magnet applicator assembly may include a sensor for detecting a position of the sheet with respect to the magnet applicator assembly, the slug applicator assembly or the gluing device. Further, the sensor may be a laser sensor for detecting a leading edge of the sheet of packaging material.

In another embodiment, the apparatus may include a programmable logic controller for controlling application of at least one of the magnet, the slug or the glue to the sheet.

In yet another embodiment, the magnet applicator assembly includes a loading passage and a magnet housing accommodating the magnets. The loading passage is in communication with the magnet housing. Additionally, the magnet applicator assembly may further include a driver and a plunger device. According to one aspect of the invention, the driver moves the magnet through the loading passage and aligns the magnet with the plunger when the driver is actuated. The magnet applicator assembly may include a diaphragm aligned with the plunger device. The diaphragm is configured to support the magnet. Actuation of the plunger device places the magnet on the glue applied to the sheet by the gluing device.

In still yet another embodiment, the slug applicator assembly may include a loading passage and a slug housing accommodating the slugs. The loading passage is in communication with the slug housing. The slug applicator assembly may further include a slug driver and a slug plunger device. The slug driver may be configured to move the slug through the loading passage and align the slug with the slug plunger device when the slug driver is actuated. The slug applicator assembly may include a diaphragm aligned with the slug plunger device. The diaphragm may be configured to support the slug. Actuation of the slug plunger device may place the slug on the glue applied to the sheet by the gluing device, such that folding of the sheet provides reclosable connection between the slug and the magnet.

In still another embodiment, the magnet housing may include a sleeve for insulation of magnetic field generated by the permanent magnet. The gluing device may dispense hot glue for attaching, for example, the magnet and the slug to the sheet. Alternatively, the gluing device may dispense cold glue for gluing, for example, the folded portions of the sheet.

Another aspect of the present disclosure is directed to a method of manufacturing or converting a reclosable container from flat stock. The method includes traversing a sheet of packaging material along a container forming device, applying a magnet in a first location of the sheet, applying a slug at a second location on the sheet, applying glue in one or more locations on the sheet, and folding the sheet of packaging material to form the reclosable container, the magnet aligning with the slug to form a reclosable connection.

In another embodiment, the method may further include detecting a leading edge of the sheet of packaging material prior to applying the magnet at the first location on the sheet.

In still another embodiment, the method of manufacturing a reclosable container may further include detecting a leading edge of the sheet having the magnet at the first location on the sheet. In yet another embodiment, the method may further include detecting a leading edge of the sheet having the magnet at the first location on the sheet prior to applying the slug at the second location on the sheet. In still another embodiment, a method of manufacturing reclosable container may further include detecting a leading edge of the sheet of packaging material prior to applying glue in one or more locations on the sheet.

Another embodiment of the present disclosure is a magnetic closure application system for integration with a folder-gluer device. The system includes a magnet applicator assembly including storage for a plurality of magnets and a slug applicator assembly including storage for a plurality of slugs. The magnet applicator assembly includes a magnet driver and a plunger. The magnet driver selects one magnet and aligns the magnet with the plunger. The plunger applies the magnet to a sheet of packaging material. The slug applicator assembly includes a slug driver and a slug plunger. The slug driver selects one slug and aligns the slug with the slug plunger, which applies the slug to the sheet of packaging material.

BRIEF DESCRIPTION OF THE DRAWINGS

The above and other objects and features of the present disclosure will become apparent from the following description of embodiments given in conjunction with the accompanying drawings, in which.

DETAILED DESCRIPTION

Figure 1:
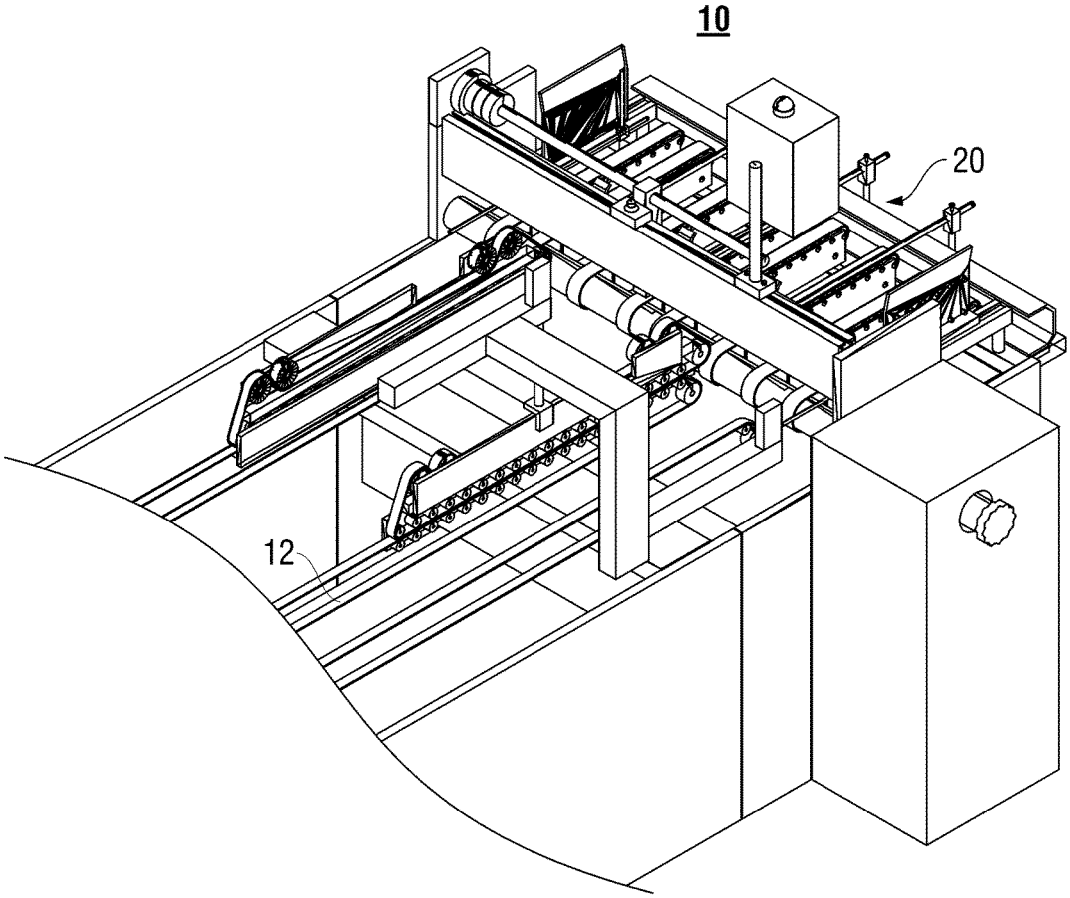
FIG. 1 (Prior Art)
FIG. 1 is a perspective view of a prior art folder-gluer machine.
Figure 2:
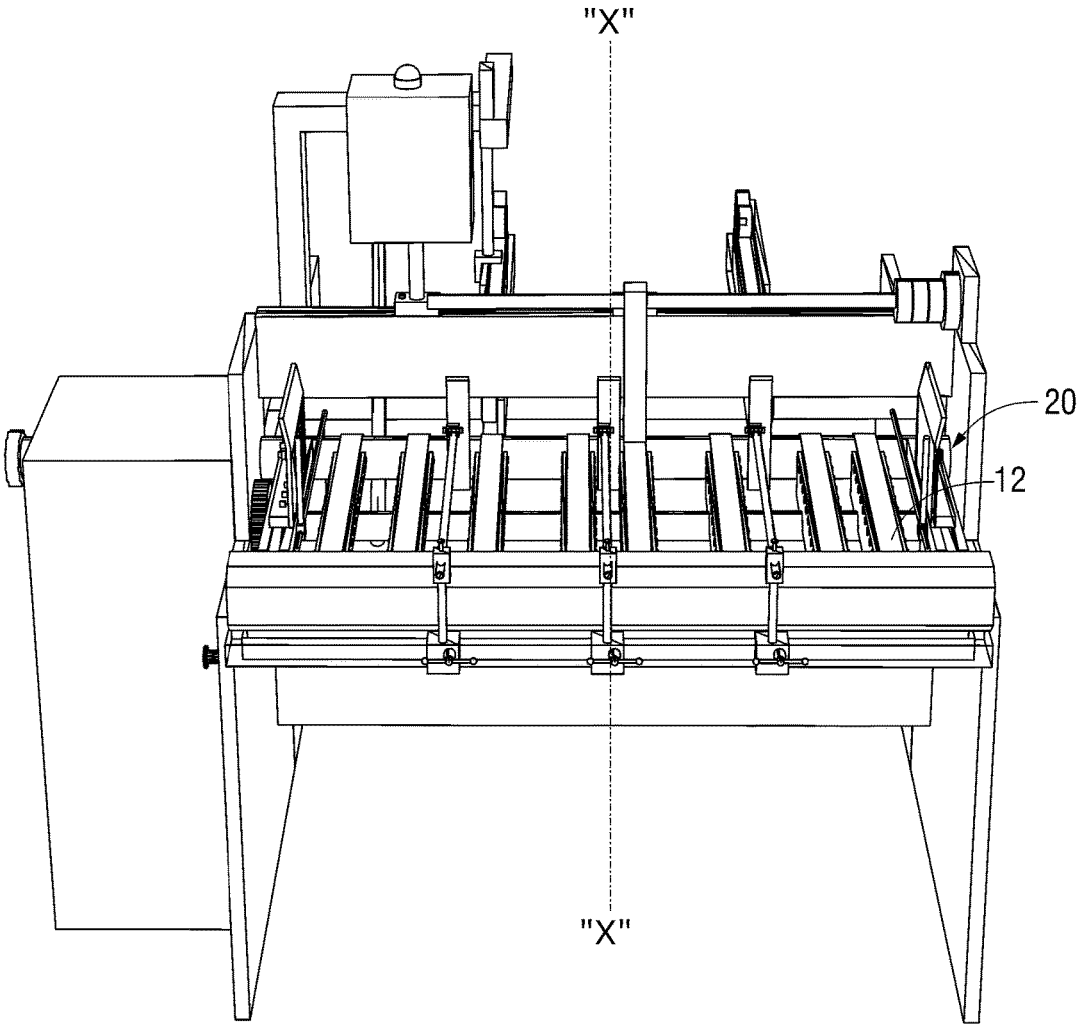
FIG. 2 (Prior Art)
FIG. 2 is a perspective view of a feeder in an upstream part of the prior art folder-gluer machine of FIG. 1.

Various embodiments of the presently disclosed apparatus for manufacture or conversion of packaging container with reclosable connection will now be described in detail with reference to the drawings, wherein like reference numerals identify similar or identical elements. The orientation of some movements or objects will be described by the terms "longitudinal" and "transversal," with reference to the central axis of the apparatus, the orientation of which depends on the direction of travel of the sheet of packaging material. Finally, the terms "upstream" and "downstream" will refer to the direction of motion of the sheet in the apparatus, as well as the beginning and ending points of the manufacturing process, respectively.

A folder-gluer machine is generally designated by the reference numeral 10 in FIG. 1. Folder-gluer machine 10 may include a number of modules depending on the manufacturing or converting operation or the type of packaging container chosen for manufacturing. Folder-gluer machine 10, however, generally includes a feeder 20 that feeds a sheet of packaging material, a breaker (not shown) for forming creases on the sheet, a gluing module, such as, a gluing module 30 shown in FIG. 11 for applying glue on the sheet, and a pressing device, such as, a pressing device 40 shown in FIG. 4. The different modules are typically arranged in a liner fashion. The sheets of packaging material are conveyed from module to module by means of belt conveyors 12, which frictionally seize the sheet either between lower and upper belts or between lower belts and upper support rollers. Typically, belt conveyors 12 are longitudinally disposed along a machine direction "MD," but are transversely adjustable according to the size of the sheets to be processed.

Figure 3:
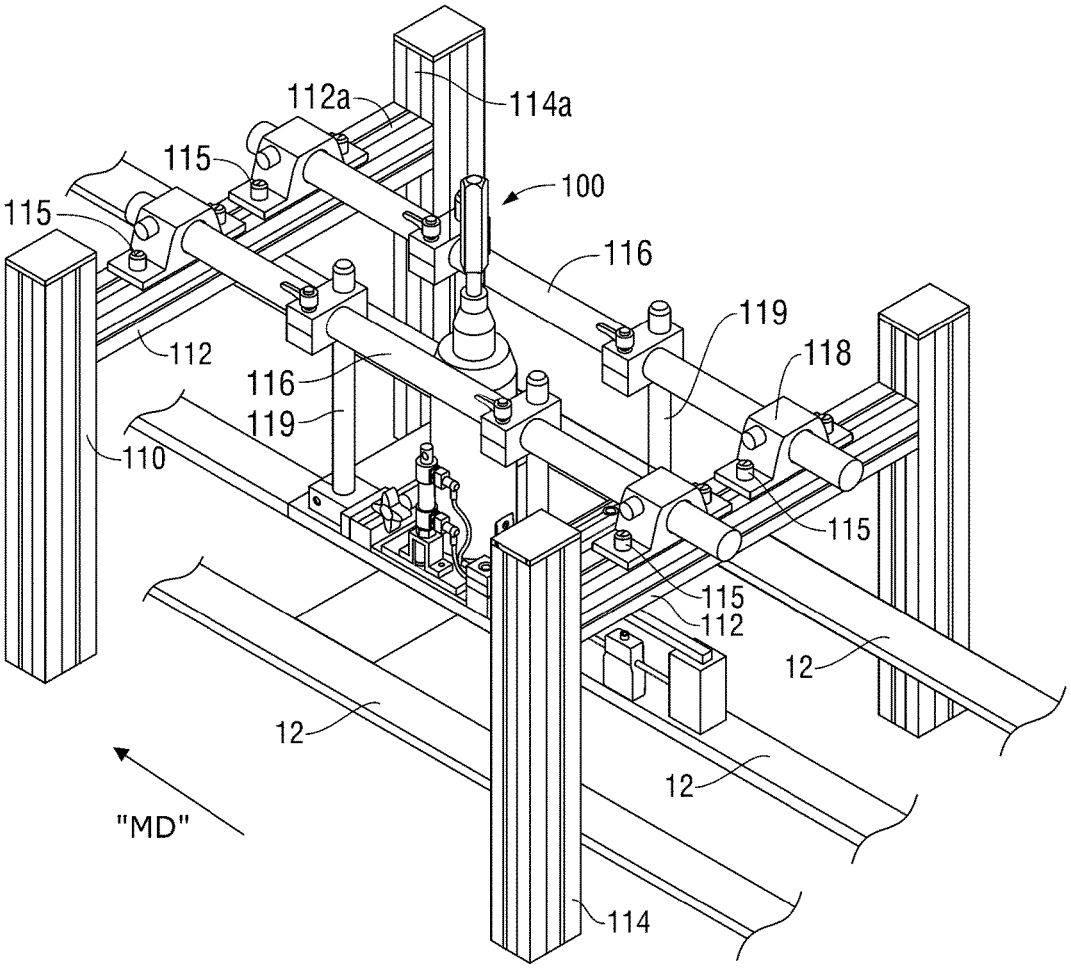
FIG. 3 is a perspective view of a magnet applicator assembly for use with an apparatus for manufacture or conversion of a packaging container with reclosable connection in accordance with an embodiment of the present disclosure.

An apparatus for manufacture or conversion of a packaging container with reclosable connection in accordance with the present disclosure may easily be integrated with folder—gluer machine 10, such as, for example, Bobst™ 100. However, the apparatus may be used as an independent unit. The apparatus for manufacture or conversion of a packaging container with reclosable connection may include a magnet applicator assembly 100 (shown in FIG. 3), a slug applicator assembly 300 (shown in FIG. 7), gluing device 30 (shown in FIG. 11), a programmable logic controller 80 (shown in FIG. 12), and a sensor 510 (shown in FIG. 13) for detecting a leading edge of the sheet of packaging material.

With reference now to FIGS. 3-6, magnet applicator assembly 100 may be supported on folder-gluer machine 10 by a frame 110. Frame 110 includes a pair of cross-bars 112 that are adjustably supported by respective posts 114. In particular, each post 114 defines a groove **114*a* for slidably receiving ends of cross-bar 112, whereby the distance between cross-bar 112 and folder-gluer machine 10 may be selectively adjusted. Magnet applicator assembly 100 is coupled to inner posts 119, which surround magnet applicator assembly 100. Inner posts 119 are securely coupled to support bars 116. Support bars 116 each include collars 118 at respective end portions of support bars 116. Collars 118 are configured to slidably translate along grooves 112*a* defined in cross-bars 112. As such, magnet applicator assembly 100 may be transversely moved with respect to the longitudinal axis "X-X" and be secured to a position along cross-bar 112 by use of screws 115 provided with collars 118. Under such configuration, the position of magnet applicator assembly 100 with respect to folder-gluer machine 10** may be tailored to meet the needs of a particular application by adjusting the mechanisms described.

Figure 4:
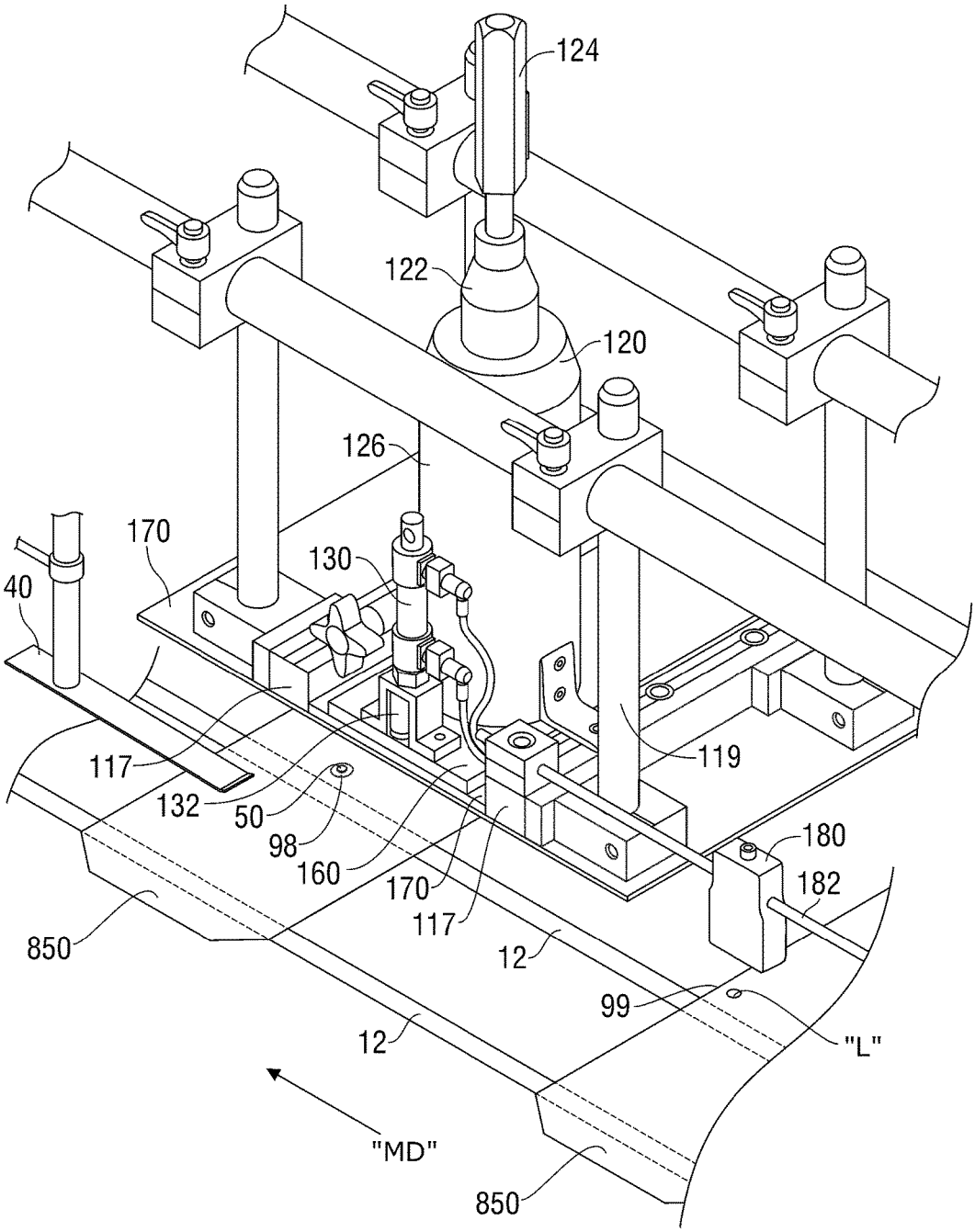
FIG. 4 is an enlarged perspective view of the magnet applicator assembly of FIG. 3.
Figure 5:
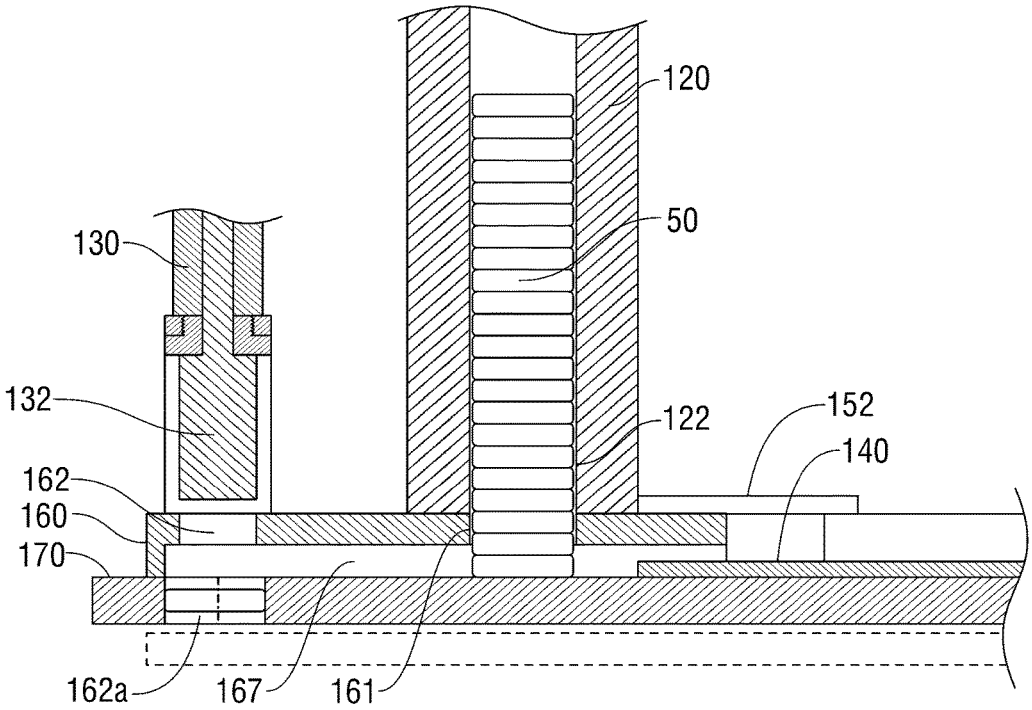
FIG. 5 is a partial transversal cross-sectional view of the magnet applicator assembly of FIG. 3.
Figure 6:
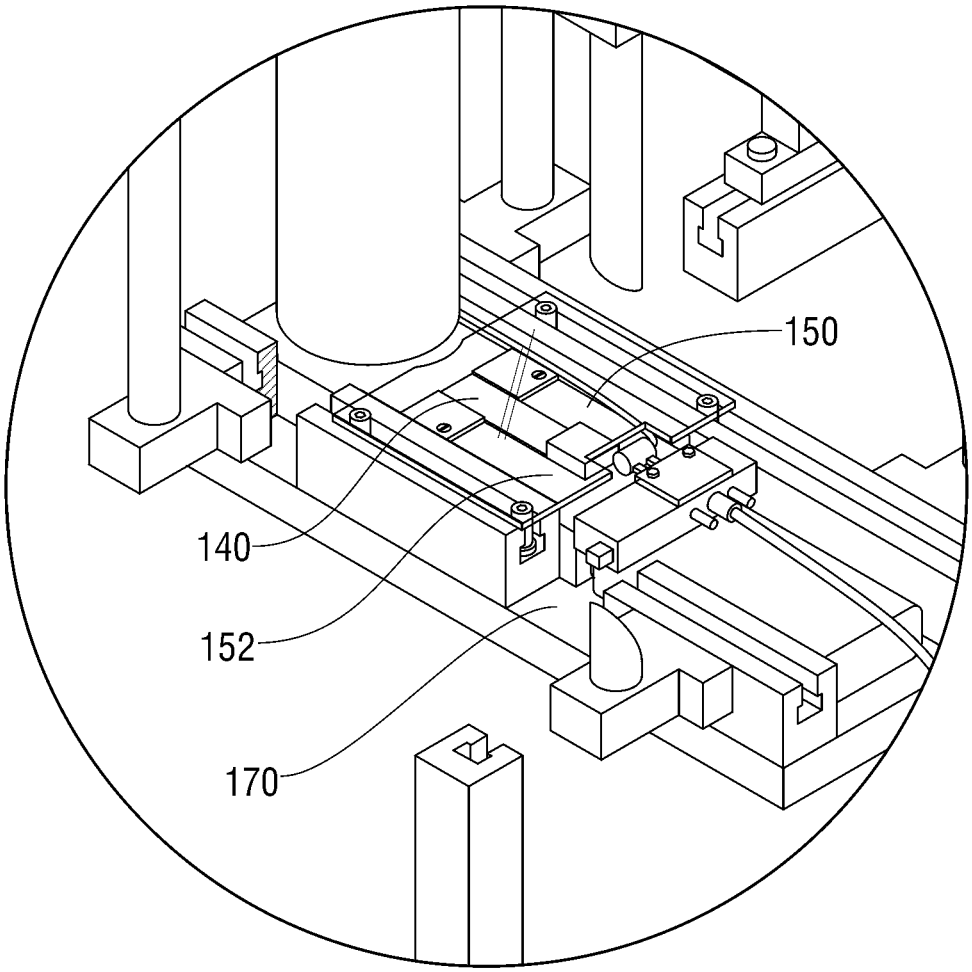
FIG. 6 is a rear perspective view of the magnet applicator assembly of FIG. 3.
Figure 14:
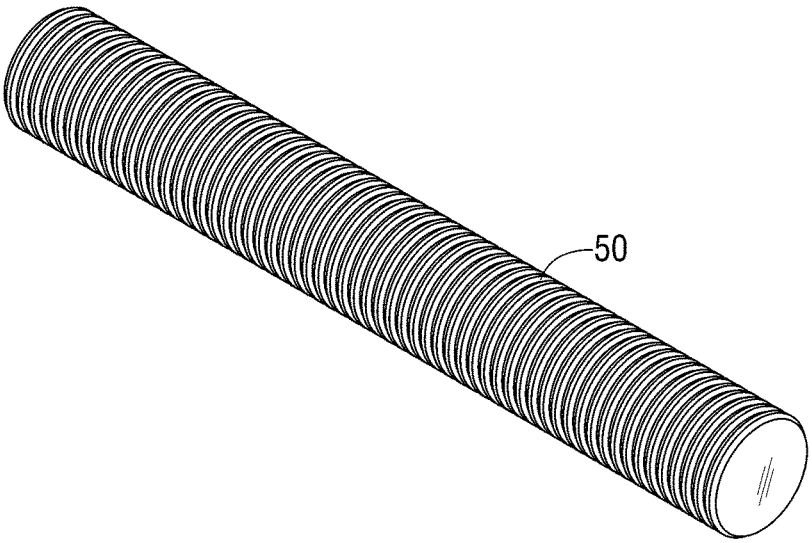
FIG. 14 is a perspective view of a plurality of magnets for use with the magnet applicator assembly of FIG. 3.

With particular reference to FIGS. 4-6, magnet applicator assembly 100 includes a magnet housing 120, a plunger device 130, a driver 140, a loading chamber 150 and a platform 160. Magnet housing 120 and plunger device 130 are disposed on platform 160 as shown in FIG. 4. Magnet housing 120 includes a cylindrical body 122 having a longitudinal bore extending therethrough. The bore is dimensioned to accommodate therein a single stack of a plurality of magnets 50 shown in FIG. 14. Cylindrical body 122 has an open top, which may be enclosed by a rod 124. Rod 124 may serve as a weight, which applies constant downward force to the stack of the plurality of magnets 50 such that at least the bottom-most magnet 50 is always in contact with a bottom surface 170 of magnet applicator assembly 100, as best shown in FIG. 5. In addition, rod 124 may include indicia on the exterior of rod 124 to enable an operator of the magnet applicator assembly 100 to visualize the remaining number of magnets 50 in cylindrical body 122. In order to reduce magnetic interference to the stack of magnets 50 loaded in the bore, it is also contemplated that rod 124 may be made of a non-ferrous material, such as brass, which also provides sufficient weight to the stack of magnets 50, and similarly a sleeve 126 enclosing, for example, the exterior of magnet housing 120, may be provided to reduce the magnetic interference created by the magnet stack.

With particular reference to FIGS. 4 and 5, magnet housing 120 and plunger device 130 are disposed on platform 160. Platform 160 defines a recess 161 and a through hole 162. Recess 161 and through hole 162 are in alignment with the bore in cylindrical body 122 and plunger device 130, respectively. Platform 160 further defines a groove 167 in communication with recess 161 and through hole 162. Groove 167 enables recess 161 and through hole 162 to be in further communication with bottom surface 170.

Bottom surface 170 of magnet applicator assembly 100 includes a diaphragm 162*a* concentrically aligned with through hole 162 defined in platform 160. Diaphragm 162*a* may be made of elastic material, such as for example, rubber or latex. Diaphragm 162*a* is configured to support a magnet 50 loaded thereon. Groove 167 is in communication with recess 161 and through hole 162. In this manner, actuation of driver 140 slidably moves the bottom-most magnet 50 from the stack of the plurality of magnets 50 in cylindrical body 122 through groove 167 onto diaphragm 162*a*.

With continued reference to FIG. 5, plunger device 130 includes a core 132 which is axially slidably supported within plunger device 130. When plunger device 130 is actuated by, for example, a pneumatic mechanism, core 132 applies downward force to magnet 50 loaded on diaphragm 162*a*. As a result of the actuation of plunger device 130, magnet 50 loaded on diaphragm 162*a* is forced downward to the sheet (shown in phantom) positioned beneath bottom surface 170 of magnet applicator assembly 100.

With particular reference now to FIG. 6 illustrating a rear view of magnet applicator assembly 100, loading chamber 150 is defined between a panel 152 and bottom surface 170. Panel 152 may be transparent as shown in FIG. 6 to assist the operator in maintenance and repair. Loading chamber 150 is dimensioned to accommodate therein driver 140. Loading chamber 150 is in communication with groove 167 defined in platform 160. An engaging portion of driver 140 is dimensioned to selectively engage a single magnet 50. In particular, the bottom-most magnet 50 is pushed by driver 140 onto diaphragm 162*a*. It is envisioned that the height of driver 140 is longitudinally constant to keep the stack of magnets 50 stable during sliding movement of driver 140. Under such configuration, actuation of driver 140 by, for example, a pneumatic mechanism or an electrically actuated relay, slidably translates driver 140 through groove 167 defined in platform 160. Driver 140 slidably moves the bottom-most magnet 50 from the stack of magnets 50 onto diaphragm 162*a*. Actuation of plunger device 130 applies downward force to magnet 50 loaded on diaphragm 162*a* placing magnet 50 onto the sheet.

With reference back to FIG. 4, magnet applicator assembly 100 may further include a sensor 180 for detecting the position of the sheet of packaging material on belt conveyors 12 with respect to, for example, plunger device 130. For example, laser sensor 180 shoots a laser beam "L" toward the sheet of packaging material to detect a leading edge of the sheet. By detecting the position of the sheet of packaging material relative to, for example, diaphragm 162*a*, plunger device 130 and driver 140 may be actuated after a predetermined time delay to take into account the travel time of the sheet from sensor 180 to, for example, diaphragm 162*a*, such that bottom-most magnet 50 is applied to a desired location on the sheet, as will be discussed below. Sensor 180 is slidably supported on a calibration rod 182 coupled to base frame 117. The position of sensor 180 may be slidably movable on calibration rod 182 to adjust the distance between sensor 180 and, for example, plunger device 130 disposed downstream of sensor 180.

With reference now to FIGS. 7-10, a slug applicator assembly 300 will be described. As described above with respect to magnet applicator assembly 100, slug applicator assembly 300 may also be adaptably integrated with folder-gluer machine 10, such as, for example, Bobst™ 100. Slug applicator assembly 300 may be supported on folder-gluer machine 10 by a frame 310. Frame 310 includes a pair of cross-bars 312 that are adjustably supported by respective posts 314. Slug applicator assembly 300 is coupled to inner posts 319, which surround slug applicator assembly 300. Inner posts 319 are further coupled to support bars 316. Support bars 316 each include collars 318 at respective end portions thereof. Collars 318 are configured to slidably translate along groove 312*a* defined in cross-bar 312. As such, slug applicator assembly 300 may be transversely moved with respect to the longitudinal axis "X-X" and be securely fixed to a desired position along cross-bar 312 by use of screws 315 provided with collar 318. Under such configuration, the position of slug applicator assembly 300 may be tailored to meet the needs of a particular application by adjusting the mechanisms described.

Figure 8:
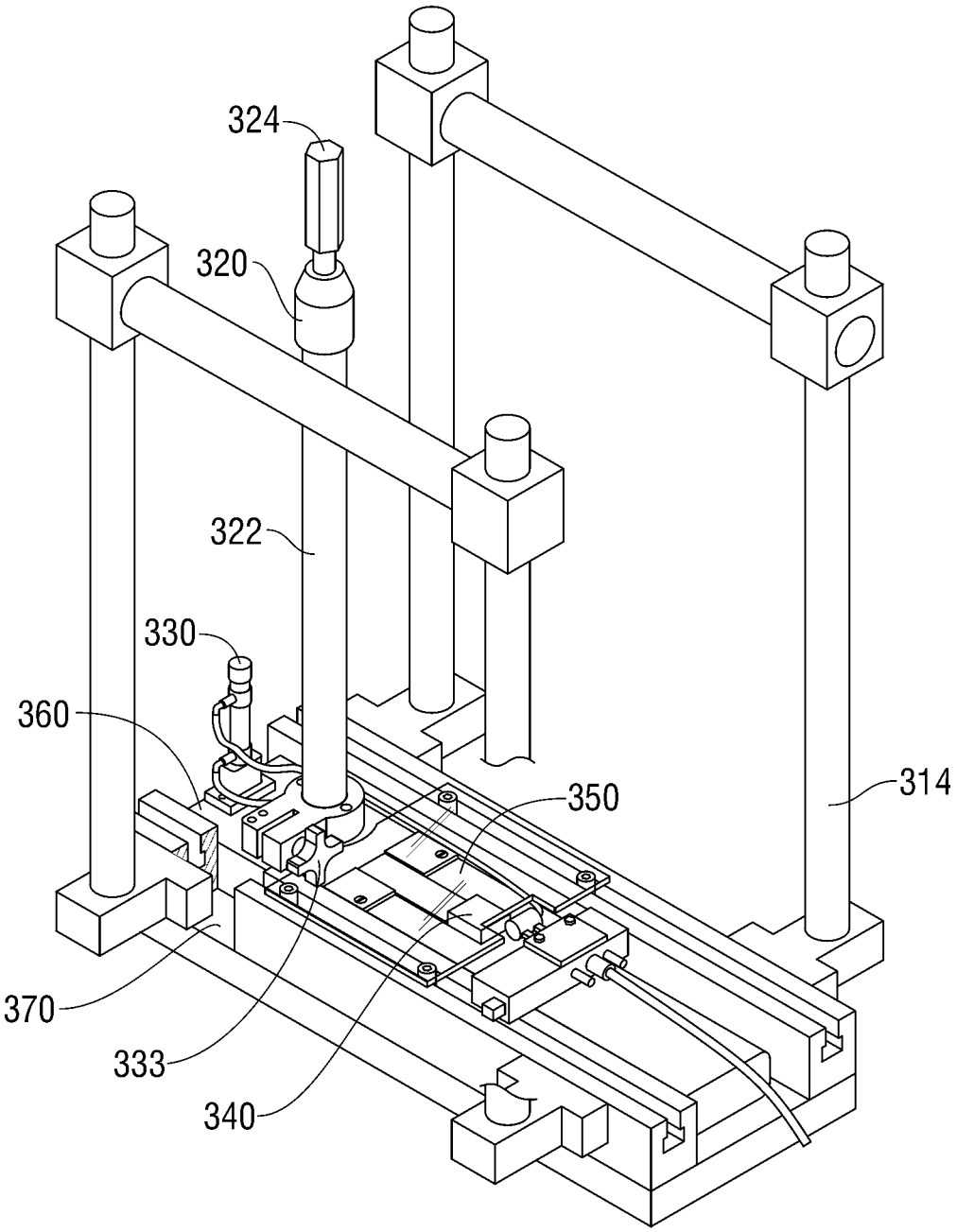
FIG. 8 is an enlarged perspective view of the slug applicator assembly of FIG. 7.
Figure 9:
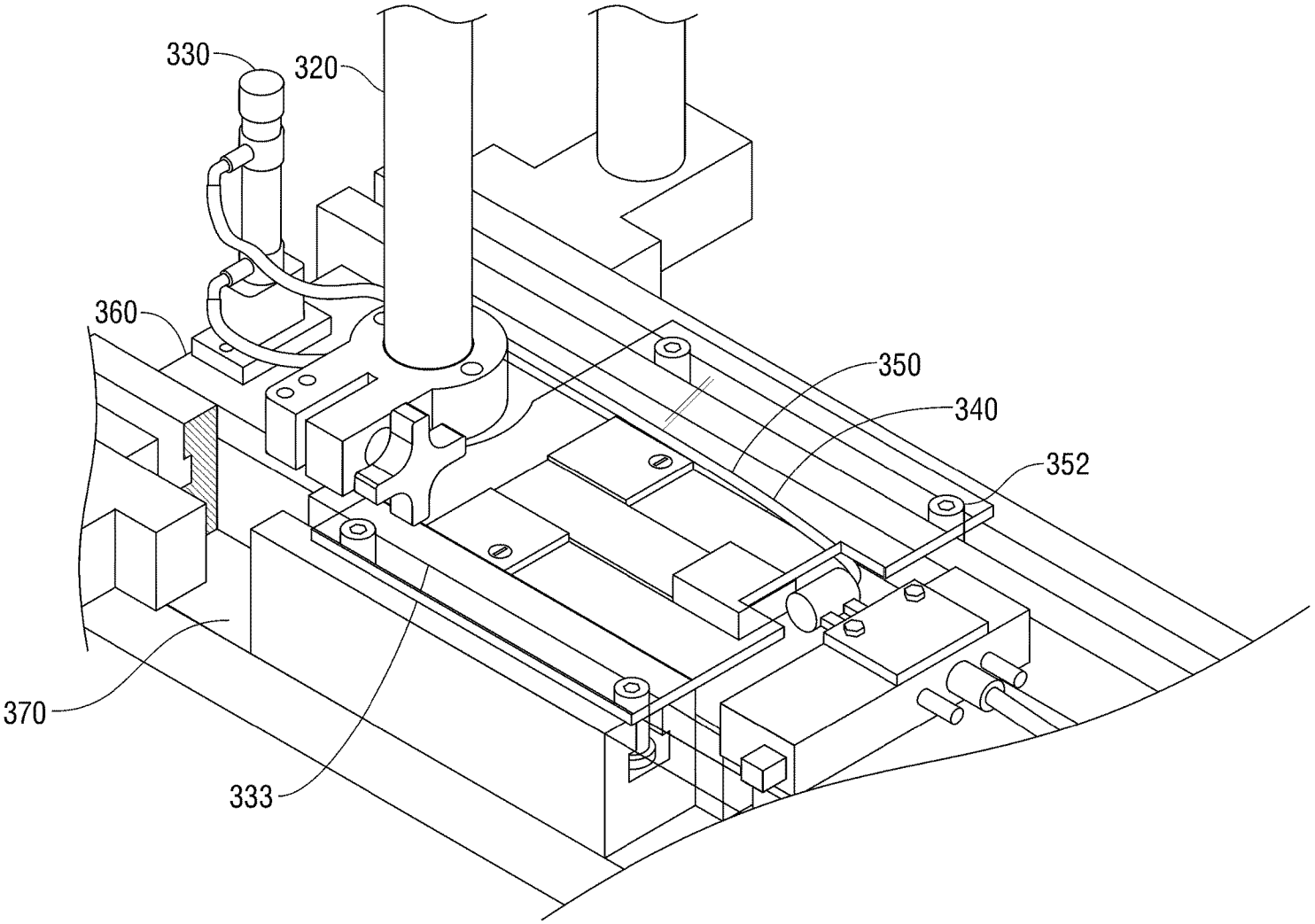
FIG. 9 is an enlarged perspective view of a loading chamber of the slug applicator assembly of FIG. 8.
Figure 10:
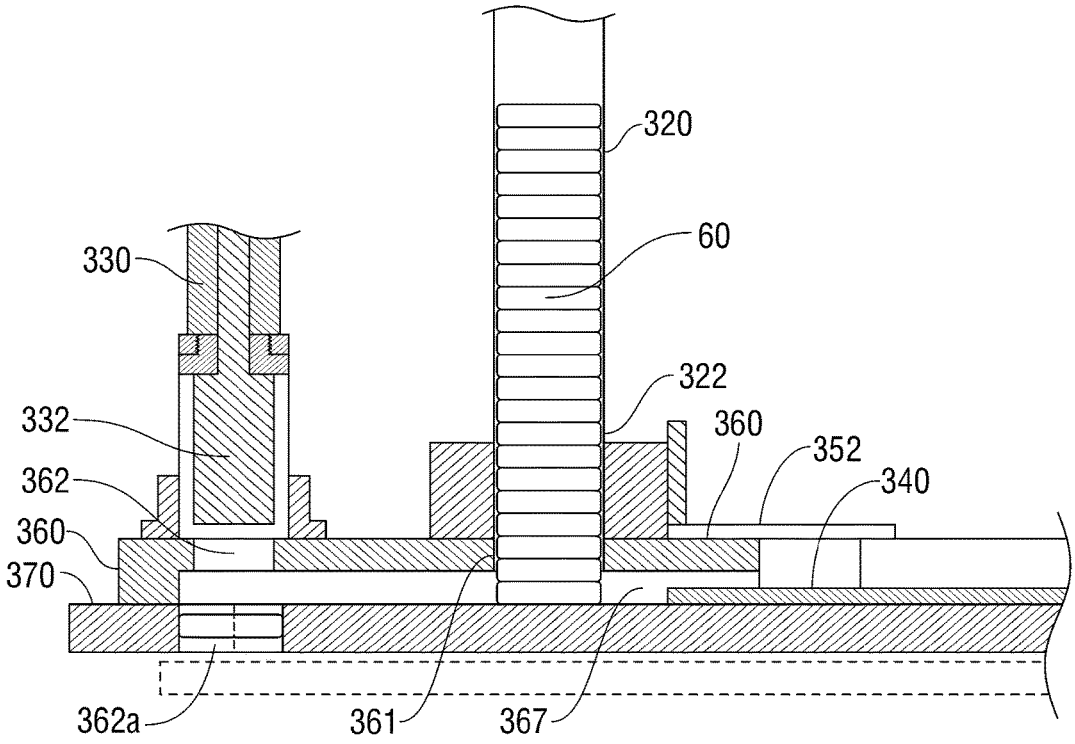
FIG. 10 is a partial longitudinal cross-sectional view of the slug applicator assembly of FIG. 8.
Figure 15:
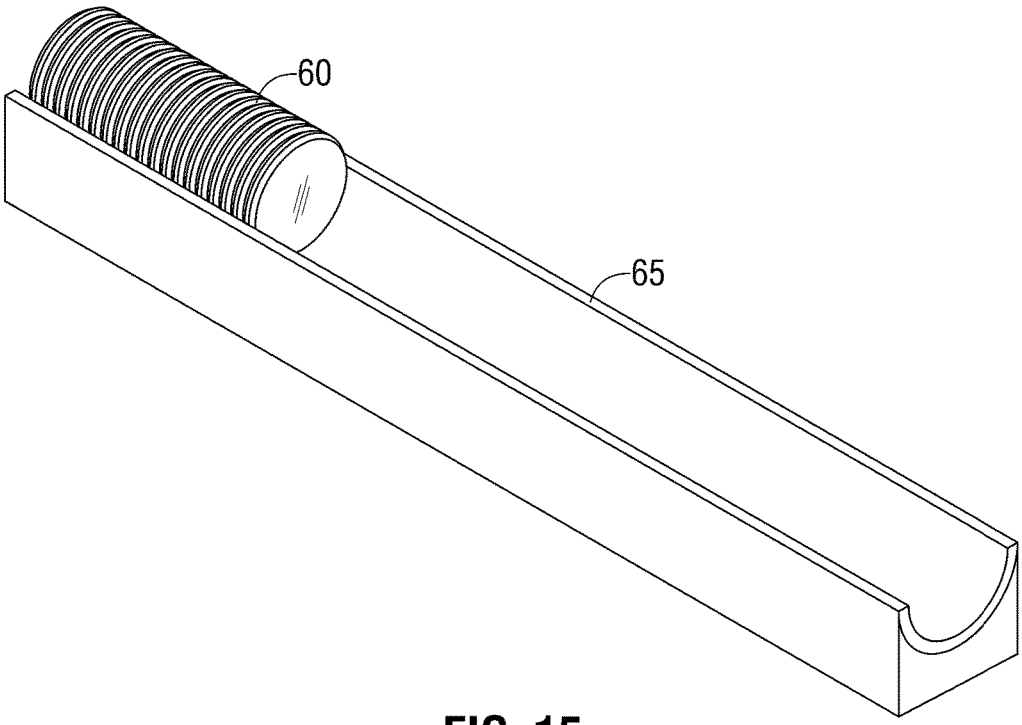
FIG. 15 is a perspective view of a plurality of slugs in a stack for use with the slug applicator assembly of FIG. 7.

With continuing reference to FIGS. 8-10, slug applicator assembly 300 includes a platform 360, a slug housing 320, a plunger device 330, a driver 340 and a loading chamber 350. Slug housing 320 and plunger device 330 are disposed on platform 360. Slug housing 320 includes a cylindrical body 322 having a longitudinal bore extending therethrough. The bore is dimensioned to accommodate therein a single stack of a plurality of slugs 60 shown in a slug loader 65 in FIG. 15. Cylindrical body 322 has an open top, which may be enclosed by a rod 324. Rod 324 may serve as a weight which applies constant downward force to the stack of the plurality of slugs 60 such that the bottom-most slug 60 is always in contact with a bottom surface 370 of slug applicator assembly 300. In addition, rod 324 may include indicia on the exterior of rod 324 to enable the operator of slug applicator assembly 300 to visualize the remaining number of slugs 60 in cylindrical body 322. Unlike magnets 50 a stack of which may be loaded into cylindrical body 122 through the opening at the top, slugs 60 may require replacement of the entire slug housing 320 as slugs 60 do not stay together when loading from the opening at the top of cylindrical body 322. For example, an empty slug housing 320 may be removed from platform 360 by loosening a clamp 333 disposed at the base of slug housing 320. The empty slug housing 32 may then be replaced with a replenished slug housing 320.

With particular reference to FIGS. 9 and 10, slug housing 320 and plunger device 330 are disposed on platform 360. Platform 360 defines a recess 361 and a through hole 362. Recess 361 and through hole 362 are in alignment with the bore in cylindrical body 322 and plunger device 330, respectively. Platform 360 further defines a groove 367 in communication with recess 361 and through hole 362. Groove 367 enables recess 361 and through hole 362 to be in further communication with bottom surface 370.

Bottom surface 370 of magnet applicator assembly 300 includes a diaphragm 362*a* concentrically aligned with through hole 362 defined in platform 360. Diaphragm 362*a* may be made of elastic material, such as for example, rubber or latex. Diaphragm 362*a* is configured to support a slug 60 loaded thereon. Groove 367 is in communication with recess 361 and through hole 362. In this manner, actuation of driver 340 slidably moves the bottom-most slug 60 from the stack of the plurality of slugs 60 in cylindrical body 322 through groove 367 onto diaphragm 362*a*.

With continued reference to FIGS. 9 and 10, plunger device 330 includes a core 332 which is axially slidably supported within plunger device 330. When plunger device 330 is actuated by, for example, a pneumatic mechanism or an electrically operated relay, core 332 applies downward force to slug 60 loaded on diaphragm 362*a*. As a result of the actuation of plunger device 330, slug 60 loaded on diaphragm 362*a* is forced downward to the sheet (shown in phantom) positioned beneath bottom surface 370 of magnet applicator assembly 300.

With continued reference to FIGS. 9 and 10, loading chamber 350 is defined between a panel 352 and bottom surface 370. Panel 352 may be transparent as shown in FIG. 10 to assist the operator in maintenance and repair. Loading chamber 350 accommodates therein driver 340. Loading chamber 350 is in communication with groove 367 defined in platform 360. An engaging portion of driver 340 is dimensioned to engage a single slug 60. In particular, the bottom-most slug 60 is pushed by driver 340 onto diaphragm 362*a*. It is envisioned that the height of driver 340 is longitudinally constant to keep the stack of slugs 60 stable during sliding movement of driver 340. Under such configuration, actuation of driver 340 by, for example, a pneumatic mechanism or an electrically operated relay, slidably translates driver 340 through groove 367 defined in platform 360. Driver 340 slidably moves the bottom-most slug 60 from the stack of slugs 60 onto diaphragm 362*a*, to enable actuation of plunger device 330 which applies downward force to slug 60 loaded on diaphragm 362*a*.

Figure 7:
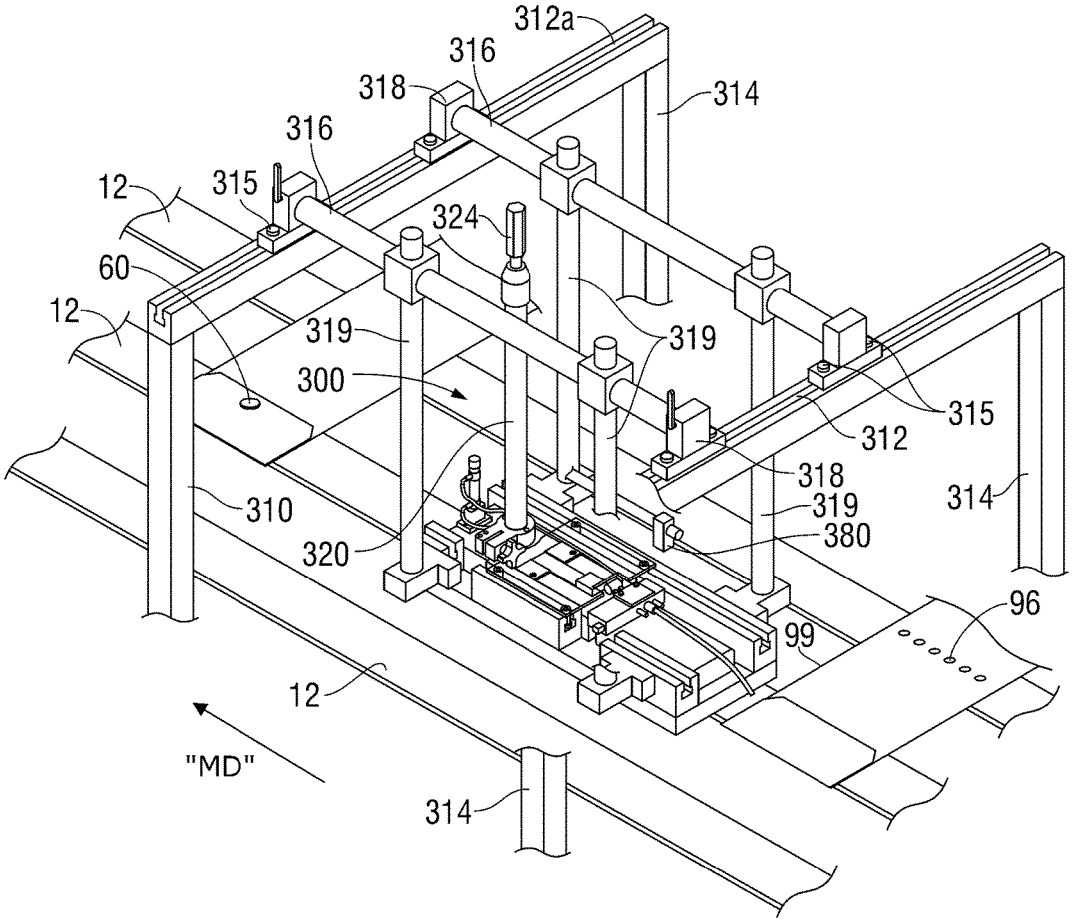
FIG. 7 is a perspective view of a slug applicator assembly for use with the apparatus for manufacture or conversion of a packaging container with reclosable connection.
Figure 11:
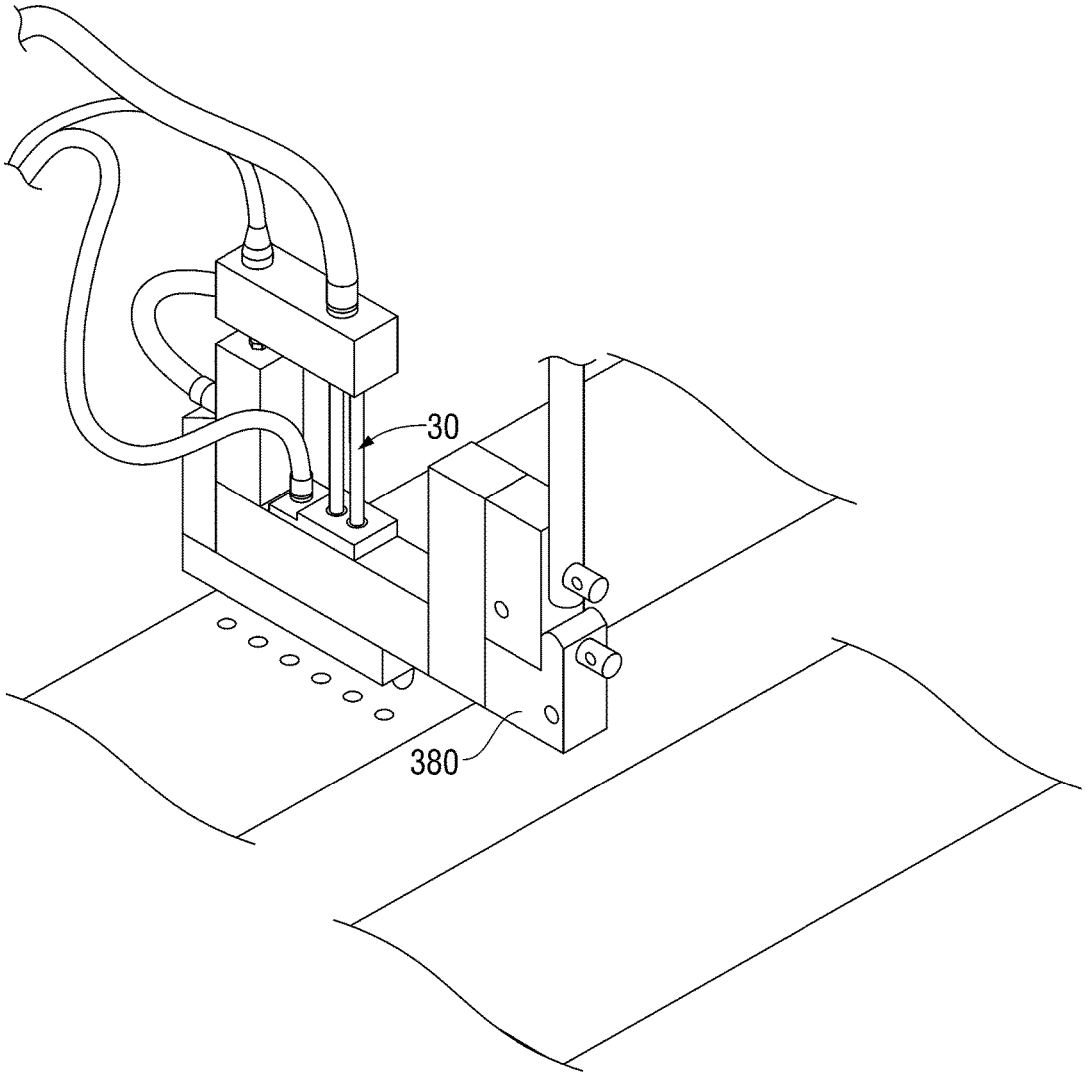
FIG. 11 is a gluing device and a sensor for use with the slug applicator assembly of FIG. 7.

With reference now to FIGS. 7 and 11, slug applicator assembly 300 or gluing device 30 may further include a sensor 380 for detecting the position of the sheet of packaging material on belt conveyors 12 with respect to, for example, plunger device 330 or gluing device 30. For example, a laser sensor 380 as shown in FIG. 7 may be utilized to detect a leading edge of the sheet. By detecting the position of the sheet of packaging material relative to, for example, diaphragm 362*a* or plunger device 330, driver 340 may be actuated after a pre-determined time delay to take into account the travel time of the sheet from sensor 380 to, for example, diaphragm 362*a*, such that bottom-most slug 60 is applied to a desired location on the sheet, as will be discussed below. Sensor 380 may also be coupled with, for example, gluing device 30 downstream of sensor 380, such that sensor 380 may be used to determine the time delay of application of glue by gluing device 30.

Figure 12:
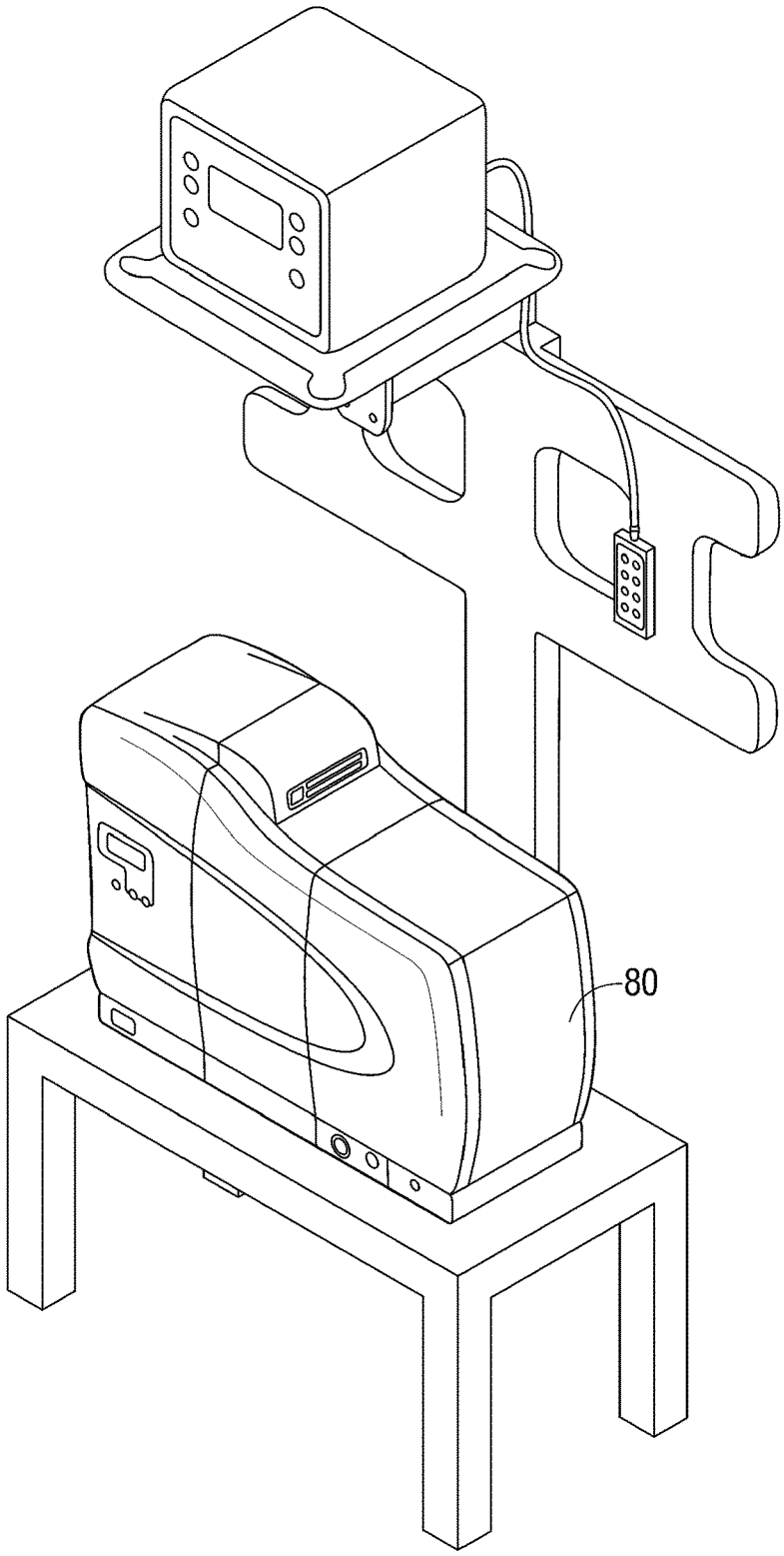
FIG. 12 is a programmable logic controller for use with the apparatus for manufacture or conversion of a packaging container with reclosable connection.

With reference to FIG. 12, the time delay between when the leading end of the sheet is detected by sensors 180, 380 and when plunger devices 130, 330 and drivers 140, 340 are actuated to apply downward force to magnet 50 or slug 60 may be automated through a use of, for example, a programmable logic controller 80. Programmable logic controller 80 may further be utilized to control the time delay in application of glue as will be discussed below. The use of programmable logic controller 80 and the sliding arrangement of magnet and slug applicator assemblies 100, 300, discussed above, render the system variable and useable with any package forming devices.

Figure 13:
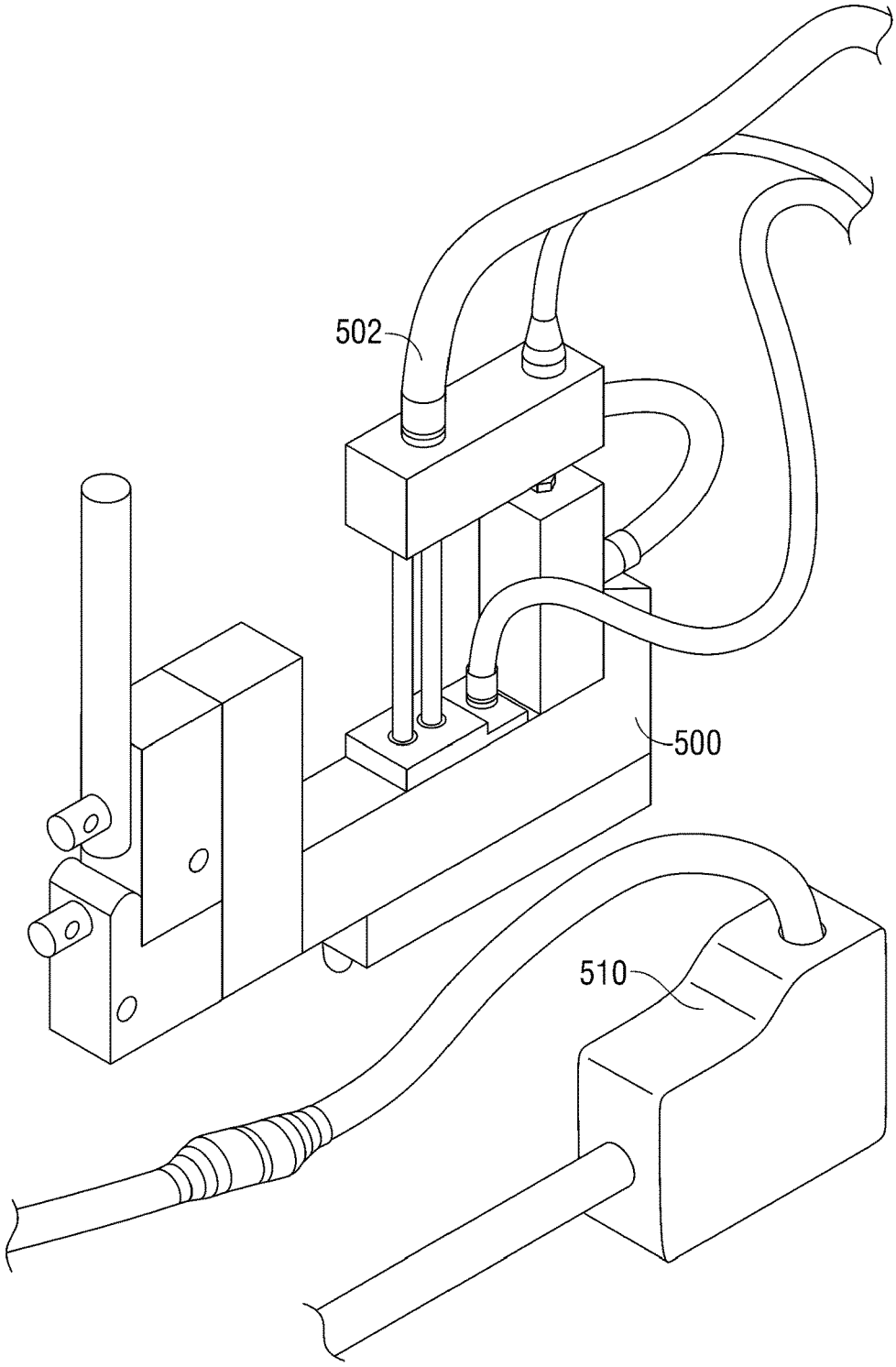
FIG. 13 is a perspective view of a gluing device for use with the magnet applicator assembly of FIG. 3.

With reference now to FIG. 13, a gluing device is shown with reference numeral 500. Gluing device 500 is connected to an external glue supply (not shown) via a supply tube 502. Gluing device 500 may include separate nozzles for supplying, for example, hot glue for attaching magnet 50 and slug 60 to the sheet and cold glue for gluing folded portions of the sheet. Gluing device 500 may further include a sensor 510, such as those described above, to detect a leading edge of the sheet, to determine the timing of application of glue to the sheet. As mentioned above, programmable logic controller 80 may be utilized to regulate and automate the time delay between application of glue and the detection of the leading edge of the sheet by sensor 510. Gluing device 500 may be placed upstream of magnet application assembly 100 and slug applicator assembly 300 to provide at least hot glue on the sheet of packaging material to attach magnet 50 and slug 60 thereon.

Figure 16:
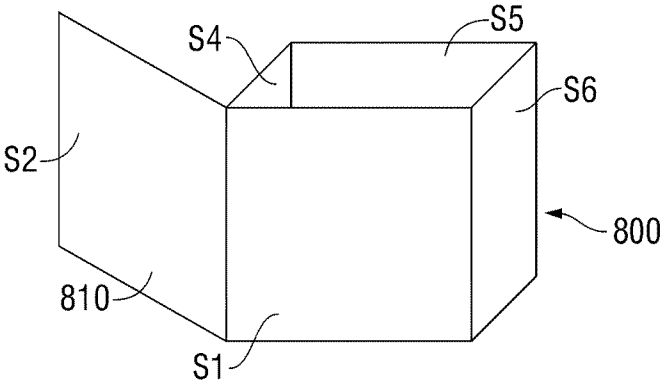
FIG. 16 is a perspective view of a box sleeve having a flap with reclosable connection.

In one exemplar operation, manufacture or conversion of a box sleeve 800 (shown in FIG. 16) having a flap 810 with reclosable connection is illustrated. In the present discussion of operation, magnet applicator assembly 100 and slug applicator assembly 300 are adaptably integrated with folder-gluer machine 10. However, as discussed above, magnet applicator assembly 100 and slug applicator assembly 300 may be used as independent units.

Initially, gluing device 500 is adaptably positioned upstream of magnet applicator assembly 100, and magnet applicator assembly 100 is adaptably positioned upstream of slug applicator assembly 300. Additionally, another gluing device 500 may also be positioned upstream of slug applicator assembly 300. Additional folding and gluing modules may be provided to place box sleeve 800 in a final glued form; however, in the interest of brevity, discussion of the additional modules is omitted.

Figure 17:
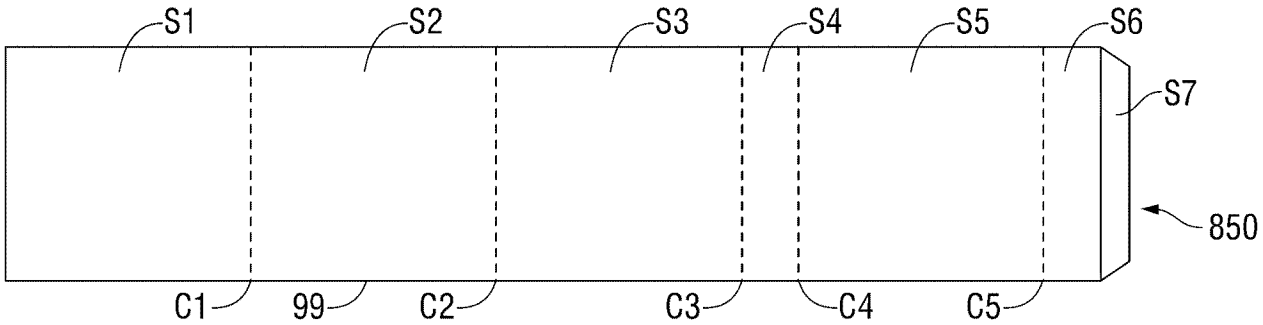
FIGS. 17-21 are top views of a sheet illustrating manufacture or conversion of the box sleeve of FIG. 16.
Figure 18:
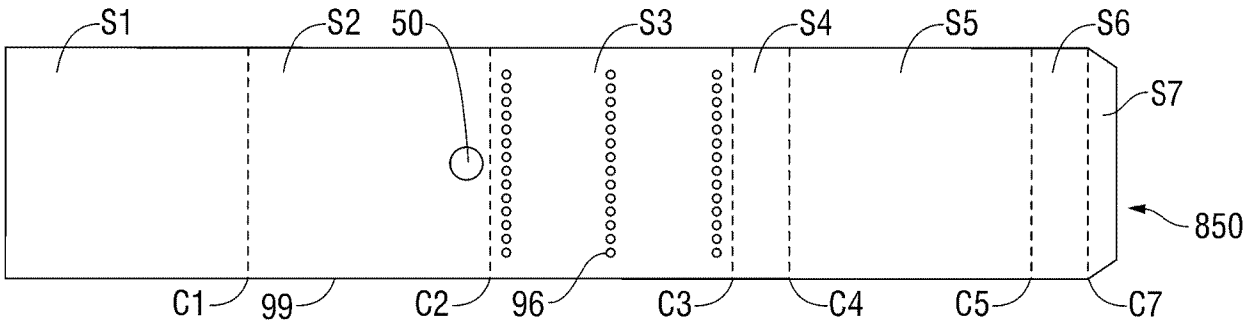

First, a sheet 850 of packaging material is placed on feeder 20. Sheet 850 includes pre-folded/creased segments S1-S7. In particular, sheet 850 includes four substantially identical large segments S1, S2, S3, S5, two substantially identical small segments S4, S6 and a glue tab S7, as shown in FIG. 17. The dimensions of each large segment S1, S2, S3, S5 define the height and width of box sleeve 800 and the dimensions of each small segment S4, S6 define the thickness of box sleeve 800. Belt conveyors 12 then convey sheet 850 to gluing device 500 upstream of magnet applicator assembly 100. Sensor 510 of gluing device 500 detects leading edge 99 of sheet 850. Then according to the time delay pre-set by the user based on the particular process, programmable logic controller 80 controls the timing of the application of glue on sheet 850 by gluing device 500. Upon applying hot glue to a location on segment S2 adjacent a crease line C2 of sheet 850, sheet 850 is then moved to magnet applicator assembly 100. Sensor 180 of magnet applicator assembly 100 shoots laser beam "L" and detects leading edge 99 of sheet 850 as shown in FIG. 4. Then programmable logic controller 80 governs the pre-determined time delay in actuating driver 140 and plunger device 130 such that magnet 50 on diaphragm 162*a* aligns with hot glue 98 placed on sheet 850 (shown in FIG. 4) when downward force is applied to magnet 50 by core 132 of plunger device 130. At this time, magnet 50 is placed on hot glue 98 on segment S2.

Figure 19:
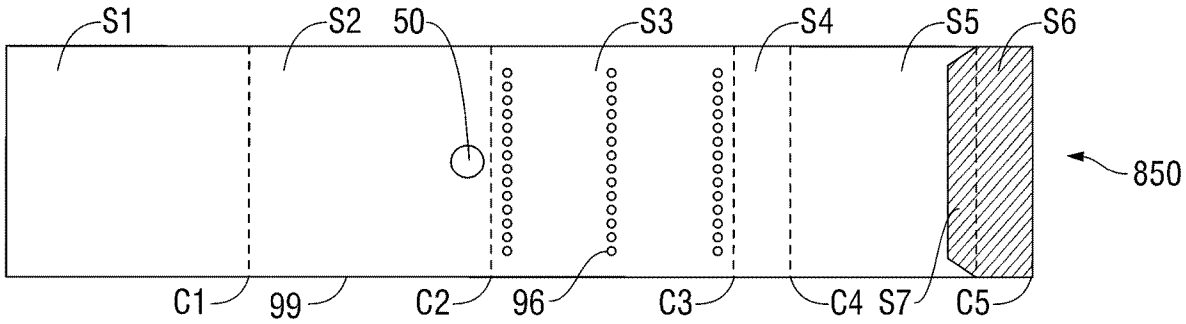

Thereafter, gluing device 500 dispenses cold glue 96 on segment S3 of sheet 850. Then the folding device of folder-gluer machine 10 folds small segment S6 and glue tab S7 over segment S5 with respect to crease line C5, as shown in FIG. 19.

Figure 20:
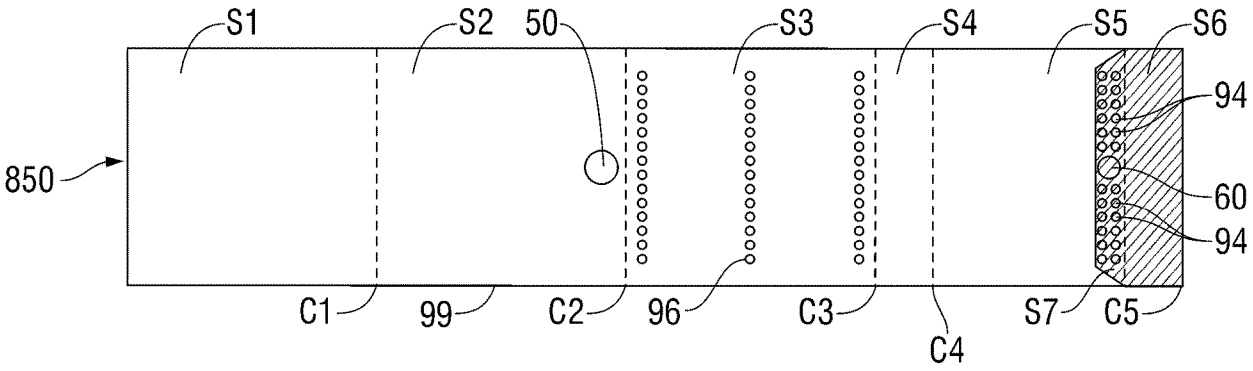

With reference now to FIG. 20, sheet 850 is sent to gluing device 30 for applying hot glue to a desired location on segment S7 of sheet 850 for attachment of slug 60. Sensor 380 may be used to determine leading edge 99 of sheet 850 in order to time dispensing of the hot glue to a desired location on segment S7 for the placement of slug 60.

Then according to the time delay pre-set by the user based on the particular process, programmable logic controller 80 controls the timing of the application of the hot glue on sheet 850 by gluing device 500. Upon applying hot glue to a desired location on segment S7, sheet 850 is then moved to slug applicator assembly 300. Sensor 380 of slug applicator assembly 300 detects leading edge 99 of sheet 850, and programmable logic controller 80 again governs the pre-determined time delay in actuating driver 340 and plunger device 330 such that slug 60 on diaphragm 362*a* aligns with the hot glue location on segment S7 of sheet 850 when downward force is applied to slug 60 by core 332 of plunger device 330.

Upon applying slug 60 on the hot glue on glue tab S7, a gluing device 500 dispenses cold glue 94 on glue tab S7 as shown in FIG. 20. A folding device (not shown) of folder-gluer machine 10 folds segments S1, S2 over segments S3, S4, S5, S7 about crease line C2, such that segments S2 overlaps segment S3 and segment S1 overlaps substantially the entire segments S4, S7 and at least partially overlaps segment S5. In this manner, magnet 50 is interposed between segments S2, S3 bonded by cold glue 96, and slug 60 is now interposed between glue tab S7 and segment S1 bonded by cold glue 94.

With reference back to FIG. 16, segments S2, S3 enclosing magnet 50 form flap 810 and segments S1, S4-S6 and glue tab S7 form the sleeve. When flap 810 (segments S2, S3) overlaps with the sleeve, magnet 50 and slug 60 align to form reclosable connection.

Figure 21:
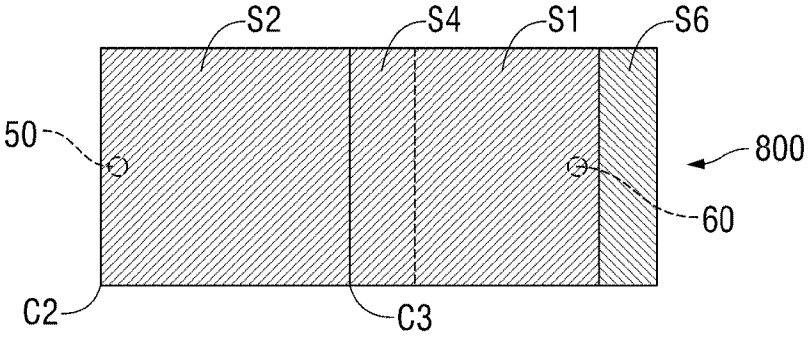
Figure 22:
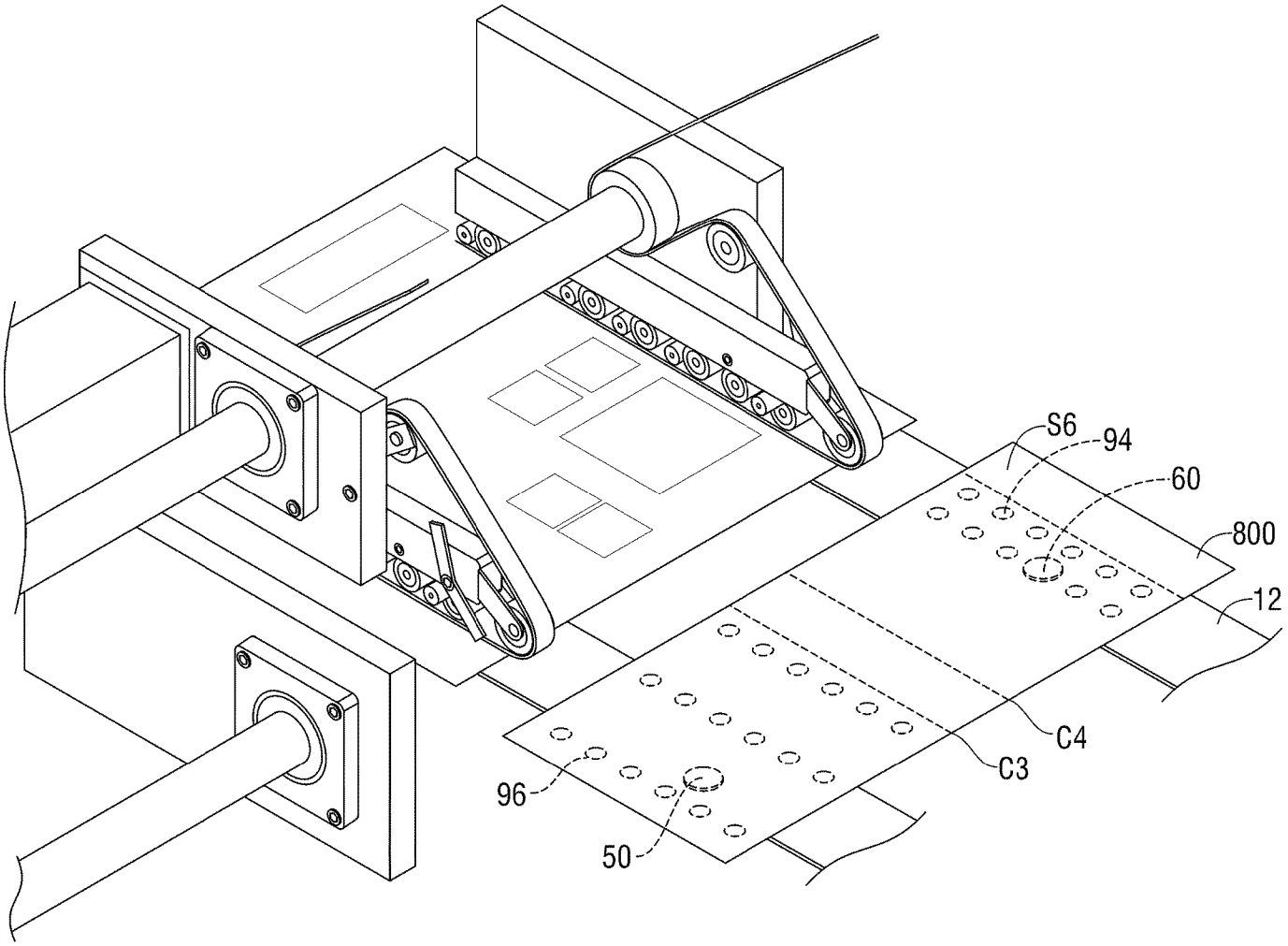
FIG. 22 is a perspective view of a delivery module for use with the apparatus for manufacture or conversion of a packaging container with reclosable connection.

The final product of box sleeve 800 having reclosable connection (as shown in FIG. 21) exits from downstream part of folder-gluer machine 10 by belt conveyors 12, as shown in FIG. 22.

Apparatus shows drivers 140, 340 of magnet applicator assembly 100 and slug applicator assembly 300 operating in transverse direction and the direction of motion ("MD") of sheet 850, respectively. However, directionality of each driver 140, 340 may be tailored to meet the particular needs of a process being performed. In addition, placement of magnets 50 and slugs 60 may be modified by the user depending on the final shape of the container. Furthermore, the number of magnets 50 and slugs 60 may be tailored to the particular application of the container to provide stronger or weaker reclosable connection. While hot glue was applied to attach magnet 50 and slug 60 to sheet 850 and cold glue was applied to bond folded segments of sheet 850, it is also contemplated that in order to simplify the manufacture process, a single type of glue may be used for both procedures. It is also envisioned that while sheet 850 included pre-folded crease lines C1-C5, crease lines C1-C5 may be formed during the manufacture or conversion process.

It will be understood that various modifications may be made to the embodiments of the presently disclosed apparatus. Therefore, the above description should not be construed as limiting, but merely as exemplifications of embodiments. Those skilled in the art will envision other modifications within the scope and spirit of the present disclosure.

What is claimed is:

1. A method of manufacturing a reclosable container comprising:

traversing a sheet of packaging material along a container forming device, wherein the sheet of packaging material includes a first segment, a second segment, a third segment, a fourth segment, a fifth segment, a sixth segment, and a seventh segment in order;

applying a magnet at the second segment;

applying a slug at the seventh segment;

applying glue in one or more locations on the sheet; and folding the sheet of packaging material to form the reclosable container along a common border between the second segment and the third segment so that the magnet is aligned with the slug forming a reclosable connection, the second segment overlaps with the third segment, and the first segment overlaps with the fourth segment, the seventh segment, and at least a portion of the fifth segment.

2. The method of manufacturing a reclosable container according to claim 1, further comprising detecting a leading edge of the sheet of packaging material prior to applying the magnet at the second segment on the sheet.

3. The method of manufacturing a reclosable container according to claim 2, further comprising detecting the leading edge of the sheet having the magnet at the second segment on the sheet prior to applying the slug at the seventh segment on the sheet.

4. The method of manufacturing a reclosable container according to claim 2, further comprising detecting the leading edge of the sheet of packaging material prior to applying glue in one or more locations on the sheet.

5. The method according to claim 1, wherein the magnet positioned in the second segment is positioned near the common border between the the second segment and the third segment of the sheet.

6. The method according to claim 1, wherein the slug positioned in the seventh segment is positioned near the common border between the sixth segment and the seventh segment of the sheet.

7. A container having a reclosable connection prepared by a process comprising:

traversing a sheet of packaging material along a container forming device, wherein the sheet of packaging material includes a first segment, a second segment, a third segment, a fourth segment, a fifth segment, a sixth segment, and a seventh segment in order;

applying a magnet at the second segment;

applying a slug at the seventh segment; and folding the sheet to form the container having the reclosable connection along a common border between the second segment and the third segment so that the magnet is aligned with the slug forming the reclosable connection, the second segment overlaps with the third segment, and the first segment overlaps with the fourth segment, the seventh segment, and at least a portion of the fifth segment.

8. The container having the reclosable connection prepared by the process according to claim 7, further applying hot glue to the second segment of the sheet prior to applying the magnet at the second segment on the sheet.

9. The container having the reclosable connection prepared by the process according to claim 8, further applying cold glue adjacent the third segment of the sheet after applying the magnet at the second segment on the sheet.

10. The container having the reclosable connection prepared by the process according to claim 9, wherein applying the magnet at the second segment is performed prior to applying the slug at the seventh segment of the sheet.

11. The container having the reclosable connection prepared by the process according to claim 10, further folding the sixth segment and seventh segment over the fifth segment along a common border line between the fifth segment and the sixth segment prior to applying the slug at the seventh segment on the sheet.

12. The container having the reclosable connection prepared by the process according to claim 11, further applying hot glue to the seventh segment of the sheet prior to applying the slug at the seventh segment on the sheet.

13. The container having the reclosable connection prepared by a process according to claim 12, further applying cold glue adjacent the seventh segment of the sheet after applying the slug at the seventh segment on the sheet.

14. The container having the reclosable connection prepared by the process according to claim 11, wherein the slug positioned in the seventh segment is positioned near the common border between the sixth segment and the seventh segment of the sheet.

15. The container having the reclosable connection prepared by the process according to claim 7, wherein the magnet positioned in the second segment is positioned near the common border between the second segment and the third segment of the sheet.

* * * * *